US005943899A

United States Patent [19]

Jung

[11] Patent Number: 5,943,899

[45] Date of Patent: Aug. 31, 1999

[54] METHOD OF PROCESSING CORNERS OF METAL PANEL

[75] Inventor: Yun Pil Jung, Yongin, Rep. of Korea

[73] Assignee: Sam Joo Aluminium Co., Ltd., Seoul, Rep. of Korea

[21] Appl. No.: 09/003,472

[22] Filed: Jan. 5, 1998

[30] Foreign Application Priority Data

Jan. 7, 1997 [KR] Rep. of Korea ..... 97-724

[51] Int. Cl.[6] ..... B21C 37/02; B21D 9/08

[52] U.S. Cl. ..... 72/379.2; 72/212

[58] Field of Search ..... 72/210, 211, 212, 72/207, 208, 379.2; 492/1, 28, 30

[56] References Cited

U.S. PATENT DOCUMENTS 419,156 1/1890 McGliehan ..... 72/212

3,613,427 10/1971 Haddon ..... 72/212

*Primary Examiner*—Joseph J. Hail, III
*Assistant Examiner*—Rodney A. Buter

[57] ABSTRACT

The present invention relates to a method of processing corners of metal panel, and more particularly to a method of processing corners of metal panel which is capable of processing the corners of the metal panel without tearing or notching of the material of the metal panel, so that the sealant or welding process thereof is not needed. The method comprises the steps of bending the metal panel according to a desired standard, the end of one side edge of each of bended portions being bended with not being bended by 100 mm from the end, and being then closely attached and fixed onto a supporter; pressing the metal panel using a roller rotationally, upwardly and downwardly moving in the vertical direction to process the corners of the metal panel; and cutting unnecessary metal piece formed in the pressing step.

3 Claims, 3 Drawing Sheets

METHOD OF PROCESSING CORNERS OF METAL PANEL

BACKGROUND OF THE INVENTION

1. Field of the Invention

The present invention relates to a method of processing corners of metal panel, and more particularly to a method of processing corners of metal panel without tearing or notching of the material of the metal panel, so that a sealant or a welding process is not needed.

2. Description of Related Art

A conventional method of processing corners of metal panel includes cutting or pressing the corners of the metal panel bending the corners, and then sealing with sealant or welding at the teared portions. As a result, since the surface of the metal panel is exposed, its appearance is not imperfect and at a step of joining the metal panels, many problems, such as water leakage, noise, particles, absorbents, etc., occur when the sealing process is performed. Further, if the welding process of the metal panels is performed, many problems such as deformation, bending, and twisting of the panel occur because of the heat generated by welding.

Moreover, when the corners of the metal panel are processed by a hydraulic press, since various molds are necessary according to the standards of products limited. Therefore, it is impossible to prepare the molds properly.

SUMMARY OF THE INVENTION

Therefore, it is an objective of the present invention to provide a method for processing the corners of metal panels without tearing or notching of the material of the metal panel, so that a sealing or welding process thereof is not needed. Accordingly, it is possible to improve the quality of the products including such metal panels as used for interior and exterior decoration in buildings, by essentially eliminating the factors causing imperfections in the products. It is also possible to simultaneously process one or more corners of the metal panel irrespective of the standard of the metal panels. As a result, it is possible to obtain the good quality metal panels of various standards and improve the productivity manufacture of the metal panels.

The present method according to a invention comprises the steps of bending the metal panel as desired, the bent end portion of a respective side edge being bent not closer 100 mm from the edge thereof, and being then closely attached and fixed onto a supporter; pressing the metal panel using a roller rotationally, upwardly and downwardly moving in the vertical direction to process the corners of the metal panel; and cutting unnecessary metal piece formed in the pressing step.

BRIEF DESCRIPTION OF THE DRAWINGS

For a complete understanding of the present invention, a preferred embodiment according to the present invention will now be described in detail with reference to the accompanying drawings in which.

DETAILED DESCRIPTION OF THE INVENTION

Figure 1:
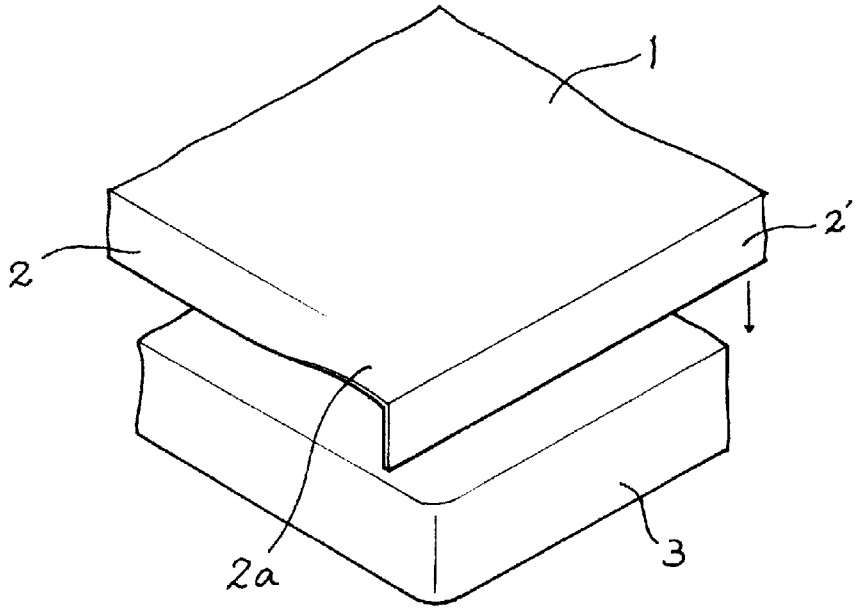
FIG. 1 is a perspective of a main part of a metal panel according to the present invention, which is in a bent state.

According to a method of processing according to corners of the metal panel of the present invention, a metal panel 1 is first bended by the desired area, but an end portion 2*a* of a respective side edge of each bent portion 2 and 2' must be not bent within 100 mm of the edge, as shown in FIG. 1.

Figure 2:
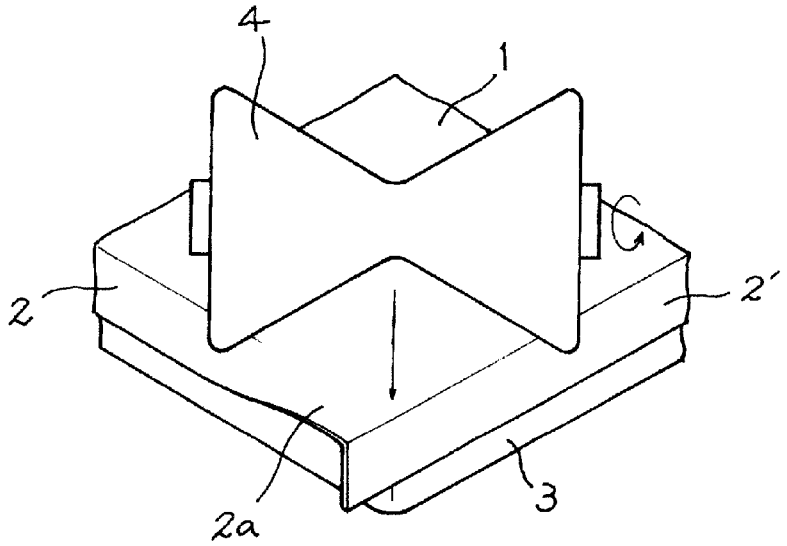
FIG. 2 is a perspective of the main part of the straight line processing the corners of the metal panel according to the present invention.

Then, the bent surfaces 2 and 2' of the metal panel 1 are closely attached and fixed onto a supporter 3, as shown in FIG. 2.

Figure 3:
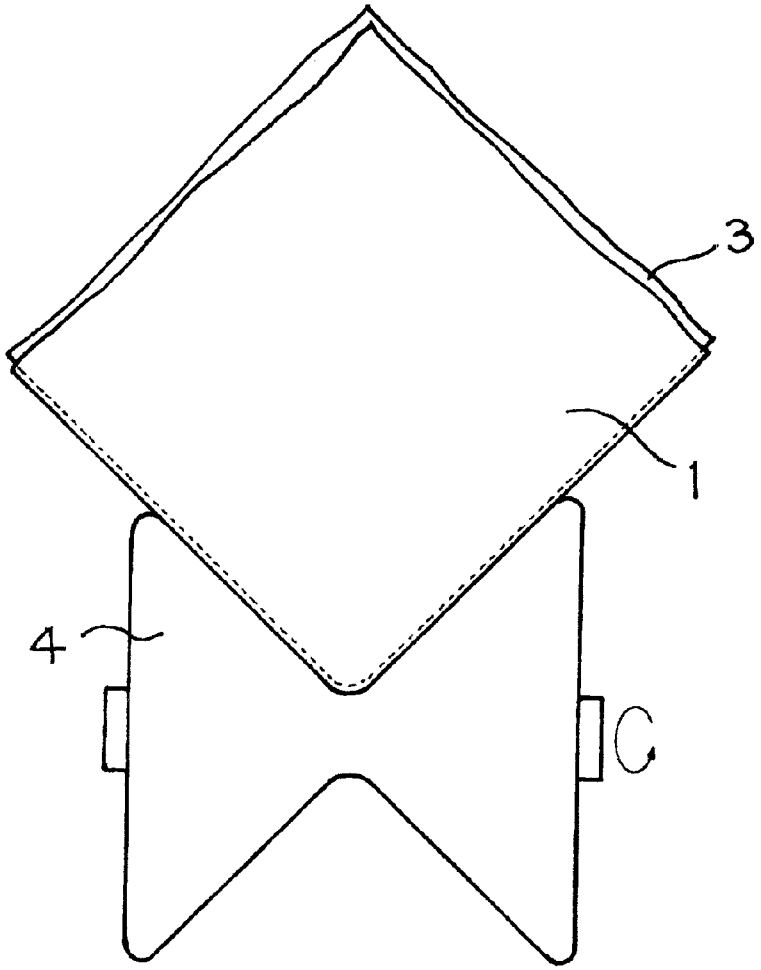
FIG. 3 is a plan view of the main part of the metal panel according to the invention, in which its corners are being processed.

Then, the bent edges of the metal panel 1 attached and fixed onto the supporter 3 are wholly rotationally pressed by a notched roller 4, upwardly and downwardly moving in the vertical direction, so that the bent corners of the metal panel 1 between the roller 4 and the supporter 3 depicted by the dotted line in FIG. 3 are uniformly processed without thinning or thickening the edges as shown in FIG. 3.

Figure 4:
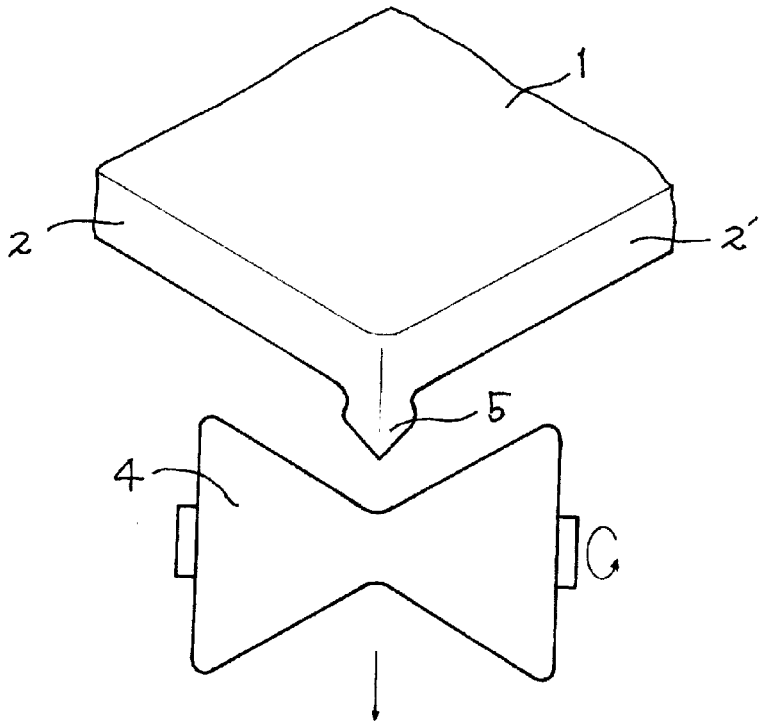
FIG. 4 is a perspective of the main part of the metal panel according to the present invention, in which corners of the metal panel have been processed.

As discussed above, while the metal panel 1 is pressed by the roller 4, the corners of the metal panel 1 are processed. Thus, an unnecessary metal piece 5 corresponding to the notched portion of the corners of the metal panel 1 which may be formed in case of conventional method is formed in the shape of cockscomb, as shown in FIG. 4.

Figure 5:
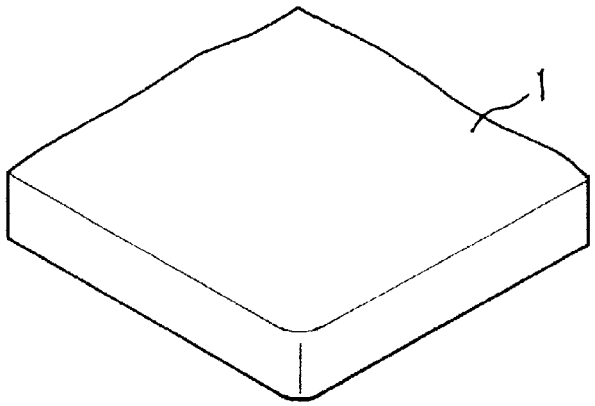
FIG. 5 is a perspective of the main part of the metal panel according to the present invention, in which corners of the metal panel have been completed.

Thus, the corners of the metal panel 1 are formed as shown in FIG. 5 by cutting off the unnecessary metal piece 5 formed after processing the corners of the metal panel 1.

The method of processing the corners of the metal panel according to the invention processes the corners of the metal panel in a Y-shape and is also called a method of Y-forming.

EFFECT OF THE INVENTION

Therefore, according to the present invention, it is possible to process the corners of a metal panel without tearing or notching the material of the metal panel, so that a sealing or welding process is not needed. Accordingly, it is possible to decrease the number of steps in processing the metal panel, to reduce processing time and obtain uniform products of various standards. As a result, it is possible to eliminate problems such as water leakage, noise, particles, absorbents, etc., so that good quality metal panels without joints are obtained.

What is claimed is:

1. A method for processing a corner portion of a metal panel comprising:

bending a first edge portion of the panel;

bending a second edge portion of the panel adjacent to the first edge portion;

placing the panel including the first and second bent edge portions on a support member shaped to conform with a surface of the panel including the first and second bent edge portions; and applying a rolling pressure to a portion of the panel where the first and second bent edge portions intersect.

2. The method according to claim 1, further comprising cutting off an extraneous metal portion resulting from applying a rolling pressure to the panel.

3. The method according to claim 2, wherein the first and second bent edge portions are bent no closer than 100 mm to respective edges of the panel.

* * * * *